United States Patent [19]

Bishop et al.

[11] 4,135,878

[45] Jan. 23, 1979

[54] EMULSIFIER-SOLVENT SCOUR COMPOSITION AND METHOD OF TREATING TEXTILES THEREWITH

[75] Inventors: Bruce J. Bishop; Allen J. Moon, both of Macon, Ga.

[73] Assignee: Star Chemicals, Inc., Macon, Ga.

[21] Appl. No.: 895,077

[22] Filed: Apr. 10, 1978

Related U.S. Application Data

[62] Division of Ser. No. 719,153, Aug. 31, 1976, Pat. No. 4,106,901.

[51] Int. Cl.[2] ..... D01C 1/00; D06L 1/00

[52] U.S. Cl. ..... 8/139; 8/139.1; 8/115.6; 252/158

[58] Field of Search ..... 8/139, 139.1, 115.6; 252/158

[56] References Cited

U.S. PATENT DOCUMENTS

| | | | |
|---|---|---|---|
| 3,380,927 | 4/1968 | Edelstein et al. | 252/308 |
| 3,658,717 | 4/1972 | Graff | 8/115.6 |
| 3,701,627 | 10/1972 | Grunewalder | 8/142 |
| 3,723,341 | 3/1973 | Raymond et al. | 252/158 |
| 3,960,742 | 6/1976 | Leonard | 252/158 |

*Primary Examiner*—William E. Schulz

*Attorney, Agent, or Firm*—Cushman, Darby & Cushman

[57] ABSTRACT

Emulsifier-solvent scour compositions which are stable at elevated temperatures when incorporated into aqueous caustic media for treatment of textile materials. The scour compositions comprise an inert organic solvent media containing:

a. 5 to 35% of at least one phosphate ester of an ethoxylated and/or propoxylated $C_8$–$C_{24}$ aliphatic or aromatic alcohol;

b. 1 to 10% of at least one $C_8$–$C_{24}$ carboxylic acid of salt thereof; and c. 4 to 20% of either i. at least one member from the group of sulfonated fatty acids or salts thereof, ethoxylated and/or propoxylated $C_8$–$C_{24}$ carboxylic acid or glyceride, sulfonated alkyl diphenyl oxide or salts thereof, or substituted imidazoline; or ii. at least one of an ethoxylated and/or propoxylated $C_8$–$C_{24}$ aliphatic or aromatic alcohol, amine or mercaptan; a sulfonated alkyl benzene, condensation products or salts thereof; or a fatty diethanol amide obtained from reacting diethanolamine with a $C_8$–$C_{24}$ fatty acid or ester.

17 Claims, No Drawings

EMULSIFIER-SOLVENT SCOUR COMPOSITION AND METHOD OF TREATING TEXTILES THEREWITH

This is a division of application Ser. No. 719,153 filed Aug. 31, 1976, now U.S. Pat. No. 4,106,901.

BACKGROUND OF THE INVENTION

The present invention relates to a composition and process for the desizing and scouring of textile materials so as to render the materials more suitable for and receptive to bleaching and dyeing treatments.

As described in U.S. Pat. No. 3,617,206, textile materials are conventionally subjected to a series of preparative treatments prior to the dyeing and finishing of the material. Generally, such preparative treatments include the desizing and scouring of the fiber which comprises the textile material so as to render the fiber more receptive to dyeing. Conventionally, the dyeing of textiles requires a four step operation initially involving a pre-bleaching or desizing treatment which may be carried out batchwise or continuously. While often times the desize treatment by which the sizing material is solubilized for removal by washing may be carried out by enzyme solution, caustic scours employing sodium hydroxide, potassium hydroxide di- or tri-ethanol amines are also known. This step is necessary in order to remove such foreign matter on the textile material as waxes, colorants and the like which may be present on the textile material and if not removed would adversely affect the transfer of dye thereto. Subsequent to the scouring treatment, greige cloth is generally subjected to an acid scouring for example by treatment with a solution containing from 0.25 to 1.0% sulfuric acid, hydrochloric acid or mixtures thereof. Then, generally subsequent to an intermediate washing step, the material is subjected to a bleaching operation which conventionally involves treatment with a solution containing 0.25 to 0.5% hydrogen peroxide and sufficient sodium silicate and caustic soda to render the solution alkaline having a pH of from about 10 to 11. After further washing, the material is then ready for dyeing.

A number of scouring compositions and surfactant-/solvent/water compositions have been employed heretofore for the treatment of textile materials so as to render same more receptive to dyeing. A number of these compositions are described for example in U.S. Pat. Nos. 3,617,206; 3,658,717 and 3,719,597. One of the problems one encounters with the scouring materials and treatment compositions of the prior art is their instability at elevated temperatures (e.g. 200° F.) in solutions containing more than about 2% caustic. Furthermore, these prior compositions do not eliminate the conventional four step treatment of the textile material prior to dyeing.

According to the present invention, there is provided an emulsifier-solvent scouring composition which is stable in at least in 3% by weight aqueous caustic solutions at elevated temperatures up to 212° F. Furthermore, the compositions of the present invention enable one to combine the conventional steps of desizing or caustic scouring and acid scouring treatment into one simultaneous operation.

Accordingly, it is a primary object of the present invention to provide an improved emulsifier-solvent scour composition which is stable in aqueous solutions containing at least 3% by weight caustic.

It is a further object of the present invention to provide a more efficient method for the treatment of textile materials to render same receptive to dyeing, and thus enhance the appearance of the resulting textile material so treated.

These and other objects of the present invention will become more apparent from the detailed description and claims which are set forth hereinbelow.

SUMMARY OF THE INVENTION

According to the present invention, emulsifier-solvent scour compositions are provided which are stable in water or aqueous solutions containing by weight at least about 3% and generally up to 15% caustic. When incorporated into an aqueous caustic solution in amounts of from 0.05% to 10% by weight, the emulsifier-solvent scour compositions of the present invention may be employed to desize and scour textile materials prior to dyeing. The scour composition is stable in aqueous solutions containing at least 3% caustic at ambient temperatures and up to about 212° F. When used in a closed pressure system, the compositions of the present invention are generally stable up to about 250° F. These compositions comprise from about 50 to 90% by weight of a solvent media of at least one inert organic solvent to provide an inert solvent media having an average kauributanol value of at least 45, preferably from about 50 to 150, and containing by weight about:

a. 5 to 35% of at least one phosphate ester of a 30 to 75% ethoxylated and/or propoxylated $C_8$–$C_{24}$ aliphatic or aromatic alcohol;

b. 1 to 10% of at least one $C_8$–$C_{24}$ carboxylic acid or salt thereof; and c. 4 to 20% of either i. at least one member from the group consisting of a sulfonated $C_8$–$C_{24}$ fatty acid or salt thereof, a 30–75% ethoxylated and/or propoxylated ester of a $C_8$–$C_{24}$ carboxylic acid, a 30–75% ethoxylated and/or propoxylated glyceride of a $C_8$–$C_{24}$ hydroxy containing carboxylic acid, and a sulfonated $C_1$–$C_{18}$ alkyl diphenyl oxide or alkali metal salt thereof;

ii. at least one of a 30–75% ethoxylated and/or propoxylated $C_8$–$C_{24}$ aliphatic or aromatic alcohol, primary or secondary amine or mercaptan; sulfonated $C_1$–$C_{18}$ aklyl benzene or salt thereof; and a $C_8$–$C_{24}$ fatty diethanol amide.

Thus, the scour compositions according to the present invention contain two main components, namely a solvent component and an emulsifier component.

The scouring agent compositions according to the present invention may suitably contain from about 50 to 90% and preferably about 60–85% by weight inert solvent media composed of at least one inert organic solvent. The solvent should be inert with respect to both textile fibers (e.g. cellulose) as well as emulsifiers present in the scour composition. In general, solvents which are suitable for the solvent media of the present invention include those conventionally employed in the cleaning of textile material and synthetic fibers in woven, non-woven (cloth and paper) tufted and flocked textile fabrications in order to remove such substances as lubricants, sizes, waxes, hand builders and softeners which may be of a paraffinic, aromatic, polymeric, natural or synthetic gum, vegetable or animal fatty origin.

The solvent media component according to the present invention suitably is composed of at least one inert organic solvent such that the solvent or combination of solvents results in a media which is characterized as having an average kauri-butanol value of at least 45 and preferably between about 50 and 150. For proper and safe work conditions, it is highly desirable, but not critical, that the solvent media have a suitable flash point for storage and use (e.g. generally at least about 70° F.).

The kauri-butanol value of the solvent media is a measure of the aromatic content, and thus the solvent power of a hydrocarbon liquid. The kauri-butanol value (K.B.) is a measure of the volume of solvent required to produce turbidity in a standard solution containing kauri gum dissolved in butanol (kauri gum being readily soluble in butanol but insoluble in hydrocarbons). In order to disperse the scour compositions of the present invention in aqueous caustic solutions containing at least 3% by weight NaOH or KOH, a solvent media having an average K.B. of at least 45 is necessary. Preferably, the average K.B. value of the solvent media is between about 50 and 150, but the upper limit is by no means critical. The average K.B. value of the solvent media ($KB_T$) is calculated by simply adding the weight fraction K.B. value for each solvent present in the total media and may be calculated as follows:

$$\left(\frac{KB_1 \times W_1}{W_T}\right) + \left(\frac{KB_2 \times W_2}{W_T}\right) + \text{etc.} = KB_T$$

where $KB_T$ = average KB value of solvent media;
$KB_1$ = KB value of solvent 1;
$KB_2$ = KB value of solvent 2;
$W_1$ = weight of solvent 1 in media;
$W_2$ = weight of solvent 2 in media; and
$W_T$ = total weight of solvent media.

Thus, for example, the average KB value ($KB_T$) of media composed of 75 parts by weight ($W_1$) of mineral spirits having a KB value of 36 and 25 ($W_2$) parts by weight xylene which has a KB value of 98 is:

$$\left(\frac{KB_1 \times W_1}{W_T}\right) + \left(\frac{KB_2 \times W_2}{W_T}\right) = KB_T$$

$$\left(\frac{36 \times 75}{100}\right) + \left(\frac{98 \times 25}{100}\right) = KB_T$$

$$27 + 24.5 = KB_T$$

$$51.5 = KB_T$$

A wide range of materials are suitable including, but by no means limited to, hydrocarbons, esters, alcohols, ketones and the like. Suitable hydrocarbons include both aliphatic and aromatic as well as halogen substituted materials. Representative materials include the $C_1$–$C_{20}$ paraffins, mineral spirits, benzene, naphthalenes, xylene, toluene, perchloroethylene, trichloroethylene, chlorinated xylenes, cyclohexane, chlorocyclohexane, trichlorobenzene, and chlorinated toluene to name but a few. Esters such as butyl stearate may also be used, but in addition numerous other aliphatic or aromatic esters of aliphatic or aromatic acids are suitable. Alcohols, halogenated if desired, may be employed. Long chain $C_6$–$C_{24}$ aliphatic alcohols (e.g. hexanol and octanol) as well as aryl alkyl alcohols are suitable. Ketones such as acetone and methylethyl ketone are useful. The K.B. value for a number of these materials which are commercially available is set forth in Table I below.

TABLE I

| Solvent | KB Value |
|---|---|
| Heptane | 30.5 |
| Hexane | 33.0 |
| Mineral Spirits | 36.0 |
| Naptha | 32.2 |
| Toluene | 105 |
| Xylene | 98 |
| Ethyl Benzene | 95.5 |
| Normal Heptane | 27.8 |
| Normal Octane | 28.2 |
| Benzene | 105+ |
| Biphenyl | 135 |
| Monomethyl Napthalene | 130 |
| Napthalene | 130 |
| Orthoxylene | 106 |
| Paraxylene | 92 |
| Pentamethyl benzene | 104 |

The emulsifier component of the scour composition is provided so as to render the resulting composition compatible with aqueous caustic or other electrolytic solutions having at least about 3% by weight caustic therein at temperatures ranging from ambient up to about 212° F.

The emulsifier component of the scour compositions is actually a tri-component blend. In each instance, the compositions contain from about 5 to 35% of at least one phosphate ester of an ethoxylated and/or propoxylated aliphatic or aromatic alcohol containing from 8 to 24 carbon atoms. These phosphate esters are conventionally characterized as liquid, biodegradable anionic surfactants. The alcohol is ethoxylated and/or propoxylated to a sufficient degree to render the hydrophobic product dispersible in water. Generally, the product should contain from about 30 to 75% by weight of the alkylene oxide substituents. The phosphate esters may be prepared by the reaction of a phosphating agent (e.g. phosphoric anhydride, phosphoric acid or polyphosphoric acid) with ethoxylated and/or propoxylated alcohols (e.g. octanol, nonyl phenol, lauryl alcohol, etc.) at temperatures ranging from about 30° to 100° C. for periods of about one to four hours. These phosphate esters are known materials and along with their method of preparation are generally described in U.S. Pat. Nos. 2,593,112; 3,004,056, 3,380,927, and 3,004,057, and *Nonionic Surfactants,* by Martin J. Schick, Marcel Dekker, Inc. New York 1 (1967), (Sometimes referred to herein as Schick), the contents each of which are incorporated herein by reference.

Suitable phosphate esters are widely available under such commercial tradenames as: Klearfac AA-040; Klearfac AA-270; Starfac 860-9; Starfac 961; GAFAC RE 610; Indoil W C; GAFAC RS 710; Texwet 1070; EMPHOS PS 415; and EMPHOS PS 220.

A second constituent of the emulsifier component is from 1 to 10% by weight of the total composition and preferably 5 to 10% of at least one carboxylic acid having from 8 to 24 carbon atoms or a salt thereof. Suitable carboxylic acids include lauryl, stearic, octanoic, linoleic, abietic and the like. Particularly well suited for the present composition is tall oil fatty acid. The salts of these acids which are well suited to the present invention are those of the Group I A alkali metals, particularly sodium and potassium. Preferably the acid component, as well as other acid moieties, is neutralized (e.g. with 1% NaOH) in the final scour composition so that upon addition of the scour composition to an aqueous caustic solution there is no loss in effective concentration of the caustic.

The third emulsifier component accounts for between about four to 20% by weight of the scour composition of:

i. at least one member from the group consisting of a sulfonated fatty acid or salt thereof containing from 8 to 24 carbons; a carboxylic acid of from 8 to 24 carbon atoms esterified with 30 to 75% by weight ethylene oxide and/or propylene oxide, a 30 to 75% by weight ethoxylated and/or propoxylated glyceride of an hydroxy containing carboxylic acid of 8 to 24 carbon atoms; and a sulfonated $C_1$ to $C_{18}$ alkyl substituted diphenyl oxide or salt thereof; or ii. at least one of an aliphatic or aromatic $C_8$–$C_{24}$ alcohol, primary or secondary amine or mercaptan which has been 30 to 75% ethoxylated and/or propoxylated; a sulfonated $C_1$–$C_{18}$ alkyl benzene or salt thereof; and a $C_8$–$C_{24}$ diethanolamide.

According to another embodiment of the invention, scour compositions are provided wherein the third emulsifier component is from 4 to 20% by weight of the total composition as follows:

0.5 to 10%, and preferably 1 to 10% of a 30–75% ethoxylated and/or propoxylated ester of a $C_8$–$C_{24}$ carboxylic acid;

0 to 15%, and preferably 1 to 15%, of a sulfonated $C_1$–$C_{18}$ alkyl diphenyl oxide or salt thereof; and 0 to 10%, and preferably 1 to 10% of sulfonated tall oil or a salt thereof. It is also preferred that the third component constitute by weight of the total composition about 1 to 10% of the sulfonated alkyl diphenyl oxide or salt thereof.

Still yet another embodiment of the present invention are those scour compositions wherein the third emulsifier component is from 4 to 20% by weight of the total composition as follows either:

4 to 10% of a $C_8$–$C_{24}$ fatty diethanol amide or a sulfonated $C_1$–$C_{18}$ alkyl benzene or salt thereof; or 2 to 15% of either a primary or secondary amine or an alcohol, said amine or alcohol being ethoxylated and/or propoxylated such that the alcohol or amine contains from 30 to 75% by weight alkylene oxide.

According to each of the various embodiments, the emulsifier component of the scour composition may also contain from about 1 to 8%, by weight of the total composition, of a substituted amphoteric imidazoline.

Particularly preferred scour compositions are formulated from:

60–85% inert solvent media having an average kauributanol value between about 50 to 150;

8–20% of a 30 to 75% ethoxylated and/or propoxylated phosphate ester;

4–10% neutralized tall oil fatty acid;

2–10% of a polyethylene glycol ester of oleic acid; and

2–10% of a diphenyl oxide sulfonate or alkali metal salt thereof.

Mixtures of mineral spirits and xylene provide a good solvent media and if desired, the scour composition may further contain from about 1 to 10%, preferably 2–10%, by weight sulfonated tall oil or an alkali metal salt thereof.

As noted, the group (i) above may include sulfonated fatty acids or alkali metal salts thereof. These materials are readily available and are generally prepared by sulfonating the appropriate carboxylic acid containing from 8 to 24 carbon atoms. Particularly, well suited for the scour compositions is sulfonated tall oil or an alkali metal salt thereof.

Component (i) may also comprise a 30–75% ethoxylated and/or propoxylated ester of a carboxylic acid. These esters have the general formula:

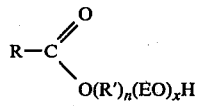

wherein

R is alkyl of 7–23 carbons;

EO is an alkylene oxide unit selected from ethylene oxide, propylene oxide and mixtures thereof; and R′ is $-(CH_2CH_2O)-$;

n is 0 or 1; and

X is equal to a sufficient number of alkylene oxide units such that the ester contains from 30 to 75% by weight of alkylene oxide units.

Also, esters include the glycol mono-esters which are ethoxylated and/or propoxylated. The esters are readily available materials and may be prepared by ethoxylating and/or propoxylating the appropriate carboxylic acid according to conventional methods as described for example in the abovementioned U.S. Pat. No. 2,593,112 and Schick (both of which are incorporated herein by reference). Suitable materials include for example the polyethylene glycol ester of oleic acid (mono-oleate) which is available from Glyco Chemicals, Inc. under the name Pegosperse 400 MO. The monostearate is also representative.

Also, component (i) may comprise a 30–75% ethoxylated and/or propoxylated glyceride of a hydroxy-containing carboxylic acid of 8 to 24 carbon atoms, such as ricinoleic acid. The selected glyceride is ethoxylated and/or propoxylated to contain between about 30 to 75% by weight of the alkylene oxide, reaction taking place with the hydroxy substituents of the glyceride. The materials may be prepared by the conventional addition (see U.S. Pat. No. 2,593,112 or Schick) of ethylene oxide, propylene oxide or mixtures thereof to the appropriate glyceride such as the triglyceride of ricinoleic acid.

The emulsifier component (i) may also contain an alkyl diphenyl oxide sulfonate or alkali metal salt thereof. The diphenyl oxide may be alkylated to contain from 1 to 18 carbon atoms. Generally, such materials are prepared for example by the condensation of the appropriate alkyl benzene sulfonic acid (e.g. dodecylbenzene sulfonic acid) followed by sulfonation of the condensation product according to conventional methods as described for example by Schick.

Particularly well suited are such surfactants as the diphenyl oxide sulfonates having the structure:

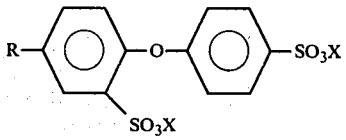

wherein R is an alkyl group of 1 to 18 carbons and X is hydrogen or sodium. These are known materials and are readily available such as for example Dowfax 3B-2, available from Dow Chemical Co.

When the third emulsifier component is chosen from the group (ii) above, one may employ suitably an ethoxylated and/or propoxylated aliphatic or aromatic alcohol, amine or mercaptan containing from 8 to 24 carbon atoms. In each case, whether it be an alcohol, amine or mercaptan, the component is ethoxylated and/or propoxylated to contain from 30 to 75% by weight of the component alkylene oxide substituents. In each case, the desired alcohol, primary or secondary amine, or mercaptan having a reactive hydrogen is reacted with an alkylene oxide selected from the group consisting of ethylene oxide, propylene oxide, or mixtures thereof in a conventional manner as described for example in U.S. Pat. No. 2,593,112 and Schick.

The alcohols which are suitable for ethoxylation and/or propoxylation according to the present invention include those materials having from 8 to 24 carbon atoms and may be aliphatic or aromatic in nature. For example, octanol, nonyl, lauryl alcohol, stearyl alcohol, phenol, and alkyl substituted phenols such as nonyl phenol. Nonionic condensates of these materials may also be used. Such condensates are formed by reacting the ethoxylated and/or propoxylated alcohol with an alkyl ester of acrylic acid containing from one to 8 carbon atoms in the presence of sodium methylate followed by treatment with a solution of sodium hydroxide to provide the desired product according to the following scheme:

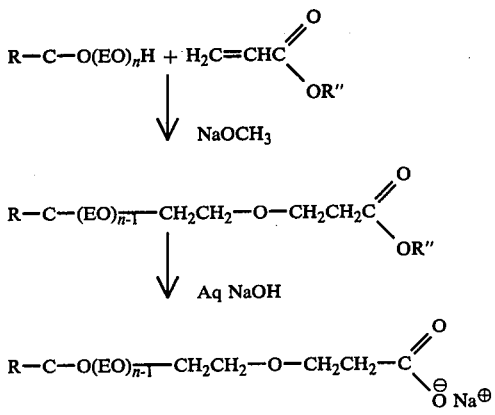

where:

R is an aliphatic or aromatic group of 8 to 24 carbons;

n is the number of ethylene and/or propylene oxide groups to constitute from 30 to 75% by weight of R-C-O(EO)H;

R" is alkyl of 1 to 8 carbons, preferably methyl and

EO represents at least one alkylene oxide unit selected from the group consisting of ethylene oxide, propylene oxide and mixtures thereof.

Non-ionic condensates of long-chain high molecular weight alcohols are available commercially such as Seyco 8961-G manufactured by Seydel-Woolley and Company, Atlanta, Georgia.

The ethoxylated and/or propoxylated amines suitable for use in the emulsifier component may be obtained by the reaction of a primary or secondary amine containing one or two fatty alkyl groups respectively, the alkyl groups containing from 8 to 24 carbon atoms, with the desired number of moles of ethylene oxide and/or propylene oxide according to conventional procedures as described in U.S. Pat. No. 2,593,112 and Schick. The reaction is carried out until the appropriate number of moles of ethylene oxide and/or propylene oxide are added to the amine to constitute 30 to 70% by weight of the total product. Suitable ethoxylated amines include for example those of oleyl amine or coconut amine. Such materials are readily available and may be obtained under such trade names as Icomeen C-15, Armeen O-15, or Armeen C-12.

The ethoxylated and/or propoxylated mercaptan emulsifier component which may be employed is thus a thioether and may be represented by the formula:

$$RS(EO)_xH$$

where

R is alkyl of 8 to 24 carbons;

EO is an alkylene unit selected from theylene oxide, propylene oxide and mixtures thereof; and X represents the number of alkylene oxide units such that the resulting thioether contains 30 to 75% by weight alkylene oxide units.

Suitable ethoxylated and/or propoxylated mercaptans include for example the dodecyl mercaptan ethoxylates represented by the general structural formula $$C_{12}H_{25}S(CH_2CH_2O)_xH$$

wherein x represents the number of moles of ethylene oxide to provide 30 to 75% by weight $+CH_2CH_2O+$ of the total thioether. These thioethers are known materials as is their preparation (see Schick, Chapter 6). Such non-ionic polyoxyethylene thioethers as Siponic-260 and Siponic-218 available from Alcolac, Inc. are well suited for the present compositions.

The component (ii) may also contain suitably a sulfonated alkyl benzene or a salt thereof. The benzene may contain alkyl substituents having a total of from 1 to 18 carbon atoms. Particularly well suited for the present invention is sodium xylene sulfonate or ammonium xylene sulfonate. The toluene sulfonates may also be equally well suited for the scour compositions. These materials are known and are described for example in *Detergent Manufacture* by Marshall Sittig, Noyes Data Corporation, pages 181–184 (1976), which is incorporated herein by reference. As noted, the toluene and/or xylene sulfonates are preferred and may be obtained commercially under the trade name Stepanate from Stepan Chemical Company, Northfield, Ill.

Very suitably, component (ii) may include a diethanolamide of a carboxylic acid containing from 8 to 24 carbon atoms. Such diethanolamides are well known in the art and may be prepared by condensing diethanolamine with a carboxylic acid containing from 8 to 24 carbon atoms or its methyl or ethyl ester. Preparation of such alkanol amides is well known and is described for example in U.S. Pat. Nos. 2,089,212 and 2,096,749, the contents of which are incorporated herein by reference. Suitable carboxylic acids include for example oleic, stearic, lauryl, as well as coconut oil, or tall oil fatty acids.

The substituted amphoteric imidazoline which may be incorporated in the scour compositions of the present invention are non-ionic surfactants of the formula

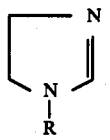

where R is an alkyl substituent of 1 to 18 carbons. Suitable materials are known and available from sources such as Lonza, Inc., under the name Amphoterge NEX.

The emulsifier-solvent compositions of the present invention may be in liquid, semi-liquid or gel form and have a clear, cloudy or translucent appearance. The pH of these compositions may range from 1.0 to 13.0 depending upon the particular selection of materials and the emulsifier(s) used. While the pH of the scour composition may vary considerably, it is preferred that the acid moieties which may be present in the scour composition be neutralized with a solution of sodium hydroxide. By so neutralizing the scour composition, one insures that upon addition of the composition to a caustic bath, the effective concentration of the caustic is not reduced.

These compositions as noted, are stable in caustic compositions containing 3% or more caustic at temperatures up to 212° F. (250° F. under pressure). Thus, the compositions of the present invention are well suited for use in plant preparation and bleach equipment such as immersion baths, desize, caustic and peroxide saturators, "J" boxes for each, bleach baths in becks and in jigs both for rope form of fabrics and for open-width form. The compositions are also suitable for use in mercerizers, steamers, ultrasonic and jet equipment, as well as in screening and centrifugal drums. The compositions may be employed in package machines both in atmospheric pressure as well as under pressure, and thus are suitable for all other types of conventional bleaching equipment used in the preparation, bleaching, dyeing and finishing of textile fibers.

The compositions according to the present invention are effective both at high and low emulsion temperatures. The materials will not corrode equipment and are physiologically acceptable. The compositions are particularly characterized by their stability and uniform dispersibility at elevated temperatures in aqueous solutions containing 3% by weight, or greater, of caustic. Suitable caustic solutions include aqueous solutions containing from 3 to 15% by weight sodium hydroxide or potassium hydroxide.

The compositions according to the present invention may be more characteristically described as a solution of at least one solvent with a mixture of surface active agents serving as emulsifiers dissolved therein to provide stability and uniform dispersibility to the resulting composition at elevated temperatures when dispersed in solutions containing at least 3% by weight caustic material.

Suitably, the emulsifier-solvent scour compositions contain from about 50 to about 90% of an inert organic solvent media and from 10 to 50% by weight of emulsifiers. These combinations of solvent and emulsifiers in caustic and non-caustic medium have been found to efficiently aid in desizing greige goods, scouring, cleaning of waxes, non-reactive hand-builders, lubricants and other sizes from woven, knit as well as non-woven cloth or paper goods. The compositions according to the present application are effective, as noted, at temperatures ranging from ambient to 212° F. for removing a variety of chemicals and substances from textile fabrics including naturally occurring pectins, waxes and oils which may be found in the textile fiber. Of course, the extent of removal of such natural occurring pectins, waxes and oils is proportional to the level of usage of the compositions in question and in this way the hand of the fabric and absorbency and dyeability of the fabric is thus controlled. The compositions are intended for use on all types of textile goods including cellulosic, polyester, polyamides (i.e. nylons), cellulosic acetate, and polyacrylic and woolen goods.

The amount of scour composition which is employed when treating the textile fabric must be determined when considering the desired resulting absorbency, hand, dyeability, and finish characteristics of the textile. We have found that an optimum level of usage of the emulsifier-solvent scour compositions according to the present invention may range from 0.05% to 10% and preferably 0.25% to 5.0% on weight fabric (i.e. OWF) depending upon the preparation of the fabric desired and the subsequent dyeing and finishing to be applied to the fabric. Generally, for most fabrics, from about 1 to 2% OWF has been found to be a suitable application.

The following examples are offered to more fully illustrate the present invention, but are not to be construed as limiting the scope thereof. In the following examples, in each instance the solvent media was composed of three parts mineral spirits (KB=36) and one part xylene (KB=98) to provide a solvent media having an average kauri-butanol value of 51.5. When present, the sodium hydroxide (50% aqueous solution) is added to neutralize the scour formulation.

EXAMPLE A

The following four compositions were prepared by mixing the appropriate solvent media having a kauri-butanol value of 51.5 to which is added the emulsifiers listed below. Upon mixing of the solvent/emulsifier formulation, sodium hydroxide (50% aqueous solution) was added to formulations 2, 3, and 4 to neutralize the tall oil fatty acid as well as other acid moieties present. Addition of the sodium hydroxide renders the emulsifiers ionic in the solvent and thus precludes reaction of the emulsifier formulation with aqueous caustic media to which it is designed to be added. The formulations were as follows:

| Formulation | 1 | 2 | 3 | 4 |
|---|---|---|---|---|
| Solvent | 72 | 74 | 72 | 77 |
| Mineral Spirits | 54 | 55.5 | 54 | 57.75 |
| Xylene | 18 | 18.5 | 18 | 19.25 |
| Emulsifiers | | | | |
| Phosphate Ester | 15 | 15 | 20 | 12 |
| Tall Oil Fatty Acid | 3 | 3 | 3 | 3 |
| Alkyl Diphenyl Oxide Sulfonate | 5 | — | — | — |
| NaOH (50%) | — | 1 | 1 | 1 |
| Amide | 5 | 8 | — | 7 |
| Ethoxylated Aliphatic Mercaptan | — | — | — | 2 |

The phosphate ester was an anionic phosphate ester Starfac 961. The alkyl diphenyl oxide sulfonate employed was Dowfax 3B-2 and the mercaptan was Siponic 218 which is a dodecyl mercaptan ethoxylate available from Alcolac, Inc.

Six grams of each of the formulations 1-4 were placed in 94 grams of 6% by weight aqueous sodium hydroxide. The mixture was then stirred to form an emulsion and heated until non-uniformity or solvent separation was observed. In each case, formulations 1-4 were stable up to 212° F. Six grams of formulations 3 and 4 were stable to 212° F. in 8% aqueous sodium hydroxide.

EXAMPLE B

The following compositions were prepared and found to be stable (2 grams of the formulation in 98 grams caustic) in 10% NaOH at 212° F. at a concentration of 2%.

| Formulation | 1 | 2 |
|---|---|---|
| Solvent | 74 | 78 |
| Mineral Spirits | 55.5 | 58.5 |
| Xylene | 18.5 | 19.5 |
| Emulsifier | | |
| Icomeen C-15 | 5.0 | 5.0 |
| Tall Oil Fatty Acid | 3.0 | 3.0 |
| Phosphate Ester | 10.0 | 7.0 |
| Staramide | 8.0 | 7.0 |

The phosphate ester which was employed was obtained from ethoxylated decyl alcohol and 2 ethyl hexanol followed by treatment with $P_2O_5$.

EXAMPLE C

The following compositions were prepared, tested as in Example A and found to be stable (6 grams formulation) in 94 grams caustic) in 8% NaOH except for formulation C-1, which was stable in 10% NaOH at 2%.

| Formulation | 1 | 2 | 3 | 4 |
|---|---|---|---|---|
| Solvent | 72 | 67 | 70 | 72 |
| Mineral Spirits | 54 | 50.25 | 52.5 | 54 |
| Xylene | 18 | 16.73 | 17.5 | 18 |
| Emulsifier | | | | |
| Phosphate Ester | 10 | 10 | 17 | 10 |
| Ethoxylated Amine | 5 | 10 | 9 | 5 |
| Tall Oil Fatty Acid | 3 | 3 | 3 | 3 |
| Nonionic Alcohol Condensate | 10 | 10 | — | 10 |

The ethoxylated amine of Formulations C-1 and C-3 was Icomeen C-15, that of C-2 being a blend of Icomeen C-15 and Armeen O-15 (from Armak Co.). The nonionic alcohol condensate of Formulations C-1, C-2, and C-4 was a condensate of a fatty alcohol (Seyco 8961). The phosphate ester was Starfac 961 which in C-2 and C-4 was blended with Texwet 1070.

EXAMPLES D-H

Formulations were prepared and found acceptable as set forth in Table II below:

Table II

| Formulation | Solvent | Mineral Spirils | Xylene | Phosphate Ester | Tall Oil Fatty Acid | Sulfonated Alkyl Phenol(1) | Sulfonated Tall Oil | Ethoxylated Glycol Ester(2) | Other |
|---|---|---|---|---|---|---|---|---|---|
| D-1 | 68 | 51 | 17 | 22 | 2 | — | — | — | 3*&5(3) |
| 2 | 62.5 | 46.9 | 15.6 | 30 | 2.5 | — | — | 2.5 | 2.5(3) |
| 3 | 70 | 52.5 | 17.5 | 20 | 5 | — | — | 5 | — |
| 4 | 60 | 45 | 15 | 25 | 5 | 3 | — | 5 | 2* |
| 5 | 61 | 45.8 | 15.2 | 25 | 4 | 4 | — | 4 | 2* |
| 6 | 61 | 45.8 | 15.2 | 25 | 4 | 2 | — | 4 | 4* |
| 6 | 61 | 45.8 | 15.2 | 25 | 4 | 2 | — | 4 | — |
| 7 | 60 | 44.2 | 14.8 | 22 | 4 | 11 | — | 4 | — |
| E-1 | 75 | 56.2 | 18.8 | 10 | 6 | 5 | — | 4 | — |
| 2 | 75 | 56.2 | 18.8 | 10 | 6 | 5 | — | 5 | — |
| 3 | 72 | 54.0 | 18 | 13 | 6 | — | 5 | 4 | — |
| 4 | 73 | 54.8 | 18.2 | 10 | 6 | 5 | 6 | — | — |
| 5 | 73 | 54.8 | 18.2 | 10 | 7 | 5 | — | 5 | — |
| 6 | 70 | 52.5 | 17.5 | 15 | 6 | 5 | — | 4 | — |
| 7 | 68 | 51 | 17 | 15 | 7 | 5 | — | 4 | — |
| F-1 | 68 | 51 | 17 | 15 | 7 | 5 | — | 5 | — |
| 2 | 68 | 51 | 17 | 15 | 7 | 5 | — | 5 | — |
| 3 | 68 | 51 | 17 | 15 | 7 | 5 | — | 5 | — |
| 4 | 68 | 51 | 17 | 15 | 7 | 5 | — | 5 | — |
| 5 | 71 | 53.2 | 17.8 | 12 | 7 | 5 | — | 5 | — |
| 6 | 73 | 54.8 | 18.2 | 10 | 7 | 5 | — | 5 | — |
| 7 | 72 | 54 | 18 | 11 | 7 | 5 | — | 5 | — |
| 8 | 68 | 51 | 17 | 15 | 7 | 5 | 3 | 2 | — |
| 9 | 68 | 51 | 17 | 15 | 7 | — | 3 | 2 | 5(4) |
| 10 | 73 | 54.8 | 18.2 | 15 | 7 | — | 5 | — | — |
| G-1 | 70 | 52.5 | 17.5 | 13 | 7 | 5 | 5 | — | — |
| 2 | 70 | 52.5 | 17.5 | 13 | 7 | 5 | — | 5 | — |
| 3 | 70 | 52.5 | 17.5 | 13 | 7 | 5 | 3 | 2 | — |
| 4 | 71 | 53.2 | 17.8 | 12 | 7 | 5 | — | 5 | — |
| 5 | 70 | 52.5 | 17.8 | 13 | 7 | 5 | 3 | 2 | — |
| 6 | 70 | 52.5 | 17.5 | 13 | 7 | 5 | 5 | — | — |
| 7 | 70 | 52.5 | 17.5 | 13 | 7 | 5 | 3 | 2 | — |
| H-1 | 68 | 51 | 17 | 15 | 7 | 5 | 3 | 2 | — |
| 2 | 72 | 54 | 18 | 11 | 7 | 5 | 3 | 2 | — |
| 3 | 73 | 54.8 | 18.2 | 11 | 7 | 4 | 3 | 2 | — |
| 4 | 74 | 55.5 | 18.5 | 11 | 6 | 4 | 3 | 2 | — |
| 5 | 70 | 52.5 | 17.5 | 13 | 7 | 5 | 3 | 2 | — |
| 6 | 79 | 59.2 | 19.8 | 9 | 5 | 3 | 3 | 1 | — |
| 7 | 80 | 60 | 20 | 8 | 5 | 3 | 3 | 1 | — |
| 8 | 80 | 60 | 20 | 8 | 5 | 3 | 3 | 1 | — |

(1)Dowfax 3B-2 - an alkyl diphenyl oxide sulfonate from Dow Chemical Company.
(2)Pegosperse 400 MO - a polyethylene glycol ester of oleic acid from Glyco Chemicals, Inc.
(3)Icomeen C-15 - an ethoxylated coconut amine with 15 moles ethylene oxide from Whitestone Chemical Company.
(4)Amphoterge NEX - a substituted amphoteric imidazoline from Lonza Chemical Company.
(*)Stepanate X - sodium xylene sulfonate from Stepan Chemical Company.

Of the above formulations, F-8, G-3, G-5, 6 and 7; and H-2 to 8 were stable at 2% in 10% NaOH to 212° F. Formulations E-1 and 2; F-1, 4, 5–7 and 9; and H-1 were stable at 2% in 8% NaOH to 212° F.

In each of the foregoing formulations, the mineral spirits has a kauri-butanol value of about 36. The xylene is an isomeric mixture (KB = 98). The preferred phosphate ester is a blend of BASF Wyandote's Klearfac AA-040 and Gafac RE-610 manufactured by General Analine Film.

EXAMPLE J

A scour composition was prepared by mixing a solvent media having an average KB = 49.9 and composed of 65 parts mineral spirits (KB = 36) and 15 parts Sure Sol 190 (an aromatic solvent available from Sun Oil Company, KB = 110). To the solvent mixture was added 5 parts Sylfat 94 (a tall oil fatty acid), 9 parts of a blend of Klearfac AA-040 and Starfac 809B, 3 parts Dowfax 3B-2 and 3 parts sulfated propyl oleate. The composition was neutralized by addition of 1.5 parts 50% NaOH, and the formulation was stable upon addition of 3 grams thereof to 97 grams 10% NaOH to the boil.

EXAMPLE K

A scour composition was prepared by initially mixing a solvent media composed of 60 parts mineral spirits having a KB value of 36 and 20 parts Hi Sol 15 (an aromatic solvent available from Whittaker Oil Company having a kauri-butanol value of 89 and a flash point of 142° F. containing 97.5 parts aromatics, 1.1 part naphthenes, and 1.4 parts paraffins). The solvent media has an average kauri-butanol value of 49.25. To the solvent media is added 8 parts by weight Starfac 806, 8 parts of a non-ionic condensation product of an ephoxylated alcohol and methyl acrylate, 4 parts tall oil fatty acid, all of which was mixed and neutralized with one part by weight 50% sodium hydroxide. The resulting formulation was tested in 4% sodium hydroxide and found to be stable in concentrations of 3% therein at the boil.

EXAMPLE L

To the solvent media of Example L is added 8 parts Starfac 806, 4 parts propyl oleate, 4 parts Sylfat 94, and 4 parts sulfated propyl oleate. The resulting formulation is neutralized with one part 50% aqueous sodium hydroxide and the resulting formulation found to be stable in 4% sodium hydroxide at concentrations up to 3% to the boil.

It may be desirable in some instances to further modify any of the above formulations by the addition thereto of up to 10% by weight of the total composition of dimer acids such as described by Edward C. Leonard in "The Dimer Acids", Humko Sheffield, which is incorporated herein by reference.

The structure of such dimer acids can be simplistically depicted as follows:

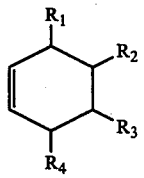

Generally speaking, dimer acids are a variety of cyclohexene-dicarboxylic acids formed by a Diels-Alder-type reaction. When head-to-head condensation has occurred, the adjacent R groups (e.g. $R^1$ and $R^2$ or $R^3$ and $R^4$) will be terminated in carboxyl groups while the other two adjacent groups will be hydrocarbon terminated. If head-to-tail condensation has occurred, the R groups will alternate in terminating carboxyl and hydrocarbon groups. The carboxy-terminating groups can have structures such as:

$-(CH_2)_8COOH$, $-CH{=}CH(CH_2)_8COOH$,
$-(CH_2)_7COOH$, $-CH_2CH{=}CH(CH_2)_7COOH$,
$-CH{=}CH(CH_2)_7COOH$ and the like;

and the hydrocarbon-terminating group can be represented by:

$CH_3(CH_2)_4-$, $CH_3(CH_2)_5-$, $CH_3(CH_2)_7-$,
$CH_3(CH_2)_4CH{=}CH-$,
$CH_3(CH_2)_4CH{=}CHCH_2-$, and others.

The dimer acids are known materials and are available from commercial sources under such names as Custofac SA-110 (Westvaco Chemicals) or Diacid 1550 having the structure:

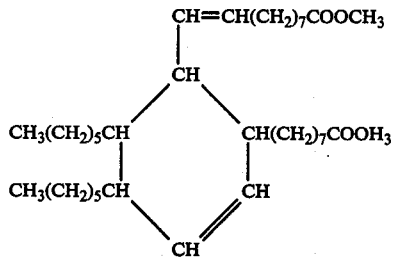

EXAMPLE M

Cotton or cotton polyester blend textile fabrics are desized by saturating the fabric with a stable high alkalinity caustic solution containing about 2% sodium hydroxide and Starfac 961. A small J-box or an open-width roller steamer is used and the fabric is treated for 20 seconds to one hour followed by washing. The fabric is then acid soured in a solution containing 0.25 to 1% sulfuric acid or sulfuric-hydrochloric acid mixture. The acid-saturated cloth is maintained at a temperature of 43° to 50° for a period of time not exceeding 45 minutes and subsequently washed. The fabric is then subjected to caustic scouring prior to bleaching. The caustic scour treatment involves a passage of the fabric through a washer, saturator, J-box and subsequent washers. The fabric is treated in the saturator with a 0.4% to 10% solution of sodium hydroxide containing therein from 0.2 to 4% of emulsifier-solvent scour composition according to Examples A-L above. The fabric is retained in the J-box for a period of from 20 seconds to one hour. The fabric is then washed to remove residual caustic and impurities solubilized in the J-box treatment such that the fabric contains less than 0.1% residual caustic. The fabric is then treated in a conventional manner to bleach the fabric. The bleaching solution contains 0.5 to 5% hydrogen peroxide (50%) and is made alkaline with the addition of 0.5 to 5% sodium silicate and 0.25 to 3% sodium hydroxide. The fabric is saturated at a temperature not exceeding 100° F. in a J-box and subsequently washed.

EXAMPLE N

Cotton or cotton polyester fabrics are treated in the same manner as Example M, except that the desize and acid sour are eliminated. The dry cloth is added directly the the caustic saturator containing sodium hydroxide and an emulsifier-solvent scour composition according to any of Examples A-L. The results are as acceptable as in Example M where both a desize and acid sour treatment are employed.

As noted hereinbefore, for most fabrics having a desired hand and finish, an amount of from 1% to 2% OWF of the emulsifier-solvent scour composition is employed in treating the textile material. In order to achieve this level, for example, an emulsion of any of the above formulations may be prepared in which 1.5% of the emulsifier-solvent scour composition is added to 98.5% of a solution of 5% sodium hydroxide. Thus, with a 100% emulsion pickup based on the weight of the fabric, 1.5% of the emulsifier-solvent scour composition based on the weight of the fabric would be obtained. Thus, by treatment of any desired textile material with the scour composition according to the present invention, one may efficiently desize and scour the fiber material to render same more receptive to dyeing and finishing treatments. In such a manner, it is particularly preferred to treat various cotton and cotton containing materials, fibers and yarns with the scour compositions according to the present invention in combination with a caustic medium such as sodium hydroxide, potassium hydroxide, or mixtures thereof.

While various modifications may be used in the specific components and procedures employed within the skill and knowledge of those in the art, depending upon the material being treated and the desired end properties thereof, the basic feature of providing efficient solvent scour by treatment of the textile material with the compositions according to the present invention remains the same.

Furthermore, the present invention may comprise, consist of, or consist essentially of the hereinbefore recited composition and procedures.

The invention being thus described, it will be obvious that the same may be varied further in many ways. Such variations are not to be regarded as a departure from the spirit and scope of the invention, and all such modifications as may be apparent to those skilled in the art are intended to be included herein.

We claim:

1. An emulsifier-solvent scour composition which is stable in aqueous solutions containing at least 3% caustic at ambient temperatures and up to about 212° F., comprising from about 50 to 90% by weight of a solvent media of at least one inert organic solvent to provide a solvent media having an average kauri-butanol value of at least 45 and containing by weight about:

a) 5 to 35% of at least one phosphate ester of a 30 to 75% ethoxylated and/or propoxylated $C_8$–$C_{24}$ aliphatic or aromatic alcohol;

b) 1 to 10% of at least one $C_8$–$C_{24}$ carboxylic acid or salt thereof; and c) 4 to 20% of either (i) at least one member from the group consisting of a sulfonated $C_8$–$C_{24}$ fatty acid or salt thereof, a 30–75% ethoxylated and/or propoxylated ester of a $C_8$–$C_{24}$ carboxylic acid, a 30–75% ethoxylated and/or propoxylated glyceride of a $C_8$–$C_{24}$ hydroxy containing carboxylic acid, and a sulfonated $C_1$–$C_{18}$ alkyl diphenyl oxide or salt thereof;

(ii) at least one of a 30–75% ethoxylated and/or propoxylated $C_8$–$C_{24}$ aliphatic or aromatic alcohol, primary or secondary amine or mercaptan; sulfonated $C_1$–$C_{18}$ alkyl benzene or salt thereof; and a $C_8$–$C_{24}$ fatty diethanol amide.

2. A composition according to claim 1, wherein said inert solvent is selected from the group consisting of hydrocarbons, halogenated hydrocarbons, esters, alcohols and mixtures thereof.

3. A composition according to claim 2 wherein said solvent is selected from the group consisting of aliphatic hydrocarbons of 1 to 20 carbon atoms, benzene, naphthalene, alkyl derivatives of naphthalene, xylene, toluene, chlorinated xylene, cyclohexane, chlorocyclohexane, chlorinated toluene, trichlorobenzene, aliphatic alcohols having from 6 to 24 carbon atoms and mixtures thereof.

4. A composition according to claim 1 wherein said solvent media is a mixture of mineral spirits and xylene.

5. An emulsifier-solvent scour composition according to claim 1 comprising from about 50 to 90% by weight of a solvent media of at least one inert organic solvent to provide a solvent media having an average kauri-butanol value of at least 45 and containing by weight about:

a) 5 to 35% of at least one phosphate ester of a 30 to 75% ethoxylated and/or propoxylated $C_8$–$C_{24}$ aliphatic or aromatic alcohol;

b) 1 to 10% of at least one $C_8$–$C_{24}$ carboxylic acid or salt thereof; and c) 4 to 20% of at least one member from the group consisting of a sulfonated $C_8$–$C_{24}$ fatty acid or salt thereof, a 30–75% ethoxylated and/or propoxylated ester of a $C_8$–$C_{24}$ carboxylic acid, a 30–75% ethoxylated and/or propoxylated glyceride of a $C_8$–$C_{24}$ hydroxy containing carboxylic acid, and a sulfonated $C_1$–$C_{18}$ alkyl diphenyl oxide or salt thereof.

6. A composition according to claim 5, wherein component (c) is about 0.5–10% of a 30–75% ethoxylated and/or propoxylated ester of a $C_8$–$C_{24}$ carboxylic acid;

0–15% of a sulfonated $C_1$–$C_{18}$ alkyl diphenyl oxide or salt thereof; and

0–10% of sulfonated tall oil or a salt thereof.

7. A composition according to claim 6, wherein component (c) is about 1 to 10% of 30–75% ethoxylated and/or propoxylated ester of a $C_8$–$C_{24}$ carboxylic acid; and 1 to 15% of a sulfonated $C_1$–$C_{18}$ alkyl diphenyl oxide; and up to 10% sulfonated tall oil or salt.

8. A composition according to claim 7 containing from about 1 to 10% of a sulfonated $C_1$–$C_{18}$ alkyl diphenyl oxide or salt thereof.

9. A composition according to claim 5 containing from about 1 to 10% of an alkyl substituted imidazoline.

10. An emulsifier-solvent scour composition according to claim 1 comprising from about 50 to 90% by weight of a solvent media of at least one inert organic solvent to provide a solvent media having an average kauri-butanol value of at least 45 and containing by weight about:

a) 5 to 35% of at least one phosphate ester of a 30 to 75% ethoxylated and/or propoxylated $C_8$–$C_{24}$ aliphatic or aromatic alcohol;

b) 1 to 10% of at least one $C_8$–$C_{24}$ carboxylic acid or salt thereof; and c) 4 5o 20% of at least one of a 30–75% ethoxylated and/or propoxylated $C_8$–$C_{24}$ aliphatic or aromatic alcohol, primary or secondary amine or mercaptan; sulfonated $C_1$–$C_{18}$ alkyl benzene or salts thereof; or a $C_8$–$C_{24}$ fatty diethanol amide.

11. A composition according to claim 10, containing from about 4 to 10% of said diethanol amide or sulfonated $C_1$–$C_{18}$ alkyl benzene or salt thereof.

12. A composition according to claim 10 containing from about 2 to 15% of either of 30–75% ethoxylated and/or propoxylated $C_8$–$C_{24}$ primary or secondary amine or alcohol.

13. A scour composition according to claim 1, comprising about:

60–85% inert solvent media having an average kauri-butanol value between about 50 and 150;
8–20% of said phosphate ester;
4–10% neutralized tall oil fatty acid;
2–10% of a polyethylene glycol ester of oleic acid; and
2–10% of a diphenyl oxide sulfonate.

14. A scour composition according to claim 13, further containing from 1 from 8% sulfonated tall oil and said solvent is a mixture of xylene and mineral spirits.

15. A scour composition according to claim 1 comprising about:

60–85% inert solvent media having an average kauri-butanol value between about 50 and 150;
8–20% of said phosphate ester;
4–10% neutralized tall oil fatty acid;
2–10% of sulfonated tall oil; and
2–10% of a diphenyl oxide sulfonate.

16. A composition according to claim 1, wherein component (b) is tall oil fatty acid.

17. A composition according to claim 16, wherein said tall oil fatty acid is neutralized.

* * * * *